United States Patent [19]

Wong

[11] Patent Number: 4,502,157

[45] Date of Patent: Mar. 5, 1985

[54] PROTECTIVE ENCLOSURES HAVING SELF-CONTAINED AIR SUPPLY

[75] Inventor: Albert H. Wong, Los Angeles, Calif.

[73] Assignee: Wong Technology, Inc., Los Angeles, Calif.

[21] Appl. No.: 267,505

[22] Filed: May 27, 1981

Related U.S. Application Data

[63] Continuation-in-part of Ser. No. 226,920, Jan. 21, 1981.

[51] Int. Cl.[3] ..... A42B 1/04

[52] U.S. Cl. ..... 2/202; 2/1

[58] Field of Search ..... 2/205, 202, 410, 5, 2/206, 9, 1

[56] References Cited

U.S. PATENT DOCUMENTS

| | | | |
|---|---|---|---|
| 996,739 | 7/1911 | Vinton | 2/205 |
| 2,676,319 | 4/1954 | Davison et al. | 2/1 |
| 2,678,444 | 5/1954 | Howerton | 2/1 |
| 2,683,876 | 7/1954 | Sullivan | 2/1 |
| 2,988,749 | 6/1961 | Grouzet | 2/205 |
| 3,951,160 | 4/1976 | Nitu | 2/202 |
| 4,266,301 | 5/1981 | Canda | 2/410 |

FOREIGN PATENT DOCUMENTS

| | | | |
|---|---|---|---|
| 2373294 | 10/1976 | France | 2/206 |
| 731635 | 8/1955 | United Kingdom | 2/202 |

*Primary Examiner*—Doris L. Troutman

*Attorney, Agent, or Firm*—Klein, Szekeres & Fischer

[57] ABSTRACT

A protective enclosure fabricated from a clear, flexible, plastic material that, in the event of an emergency, is easily positionable over at least the head of a wearer to protect the wearer from the adverse effects of a contaminated environment, such as that filled with smoke or similar noxious fumes.

The enclosure is provided with an opened side for receiving therethrough the head of the wearer. The ends of the enclosure which define the opened side thereof are structured so as to generally conform to the shape of a human chest. The aforementioned ends which define the opened side are provided with fastening means by which the opened side may, be secured to the chest of the wearer in order to form an airtight fit therebetween and thereby close the opened end against the chest and around the neck of the wearer.

Hence, a relatively low cost, reliable, and easily operable protective enclosure is provided that can be folded and conveniently placed in a pouch for either storage or distribution, such as to the occupants of a high-rise building or to passengers of an airplane for use in the event of fire, or similar catastrophe.

11 Claims, 9 Drawing Figures

PROTECTIVE ENCLOSURES HAVING SELF-CONTAINED AIR SUPPLY

CROSS REFERENCES TO RELATED PATENT APPLICATIONS

This patent application is a continuation-in-part of application Ser. No. 226,920 filed Jan. 21, 1981.

BACKGROUND OF THE INVENTION

1. Field of the Invention

This invention relates to a relatively low cost and compact protective enclosure that is adapted to protect a wearer from the adverse effects of a contaminated environment, such as that which may contain smoke, toxic or noxious gases, and the like, by providing a self-contained supply of air from which the wearer may breathe in the event he is trapped within the contaminated environment.

2. Prior Art

Suffocation remains a major cause of death resulting from either of an airplane crash, a fire in a high-rise building, chemical fires, and the like. An individual may suffocate while being trapped within a contaminated environment, such as the scene of an accident, due to the inhalation of noxious gases, including smoke and various toxic fumes. By way of particular example, as an undersirable by-product of a fire, many plastic materials will generate toxic fumes when exposed to a flame. The fabrication of many components in the passenger compartment of an airplane or a subway car are capable of producing such undesirable toxic fumes in the event of a fire. What is more, individuals trapped during a fire within a high-rise building may find their welfare jeopardized as a result of relatively large amounts of smoke which tend to billow to the upper floors of the building. Hence, the occupants of high-rise buildings, airplanes and other sources of transportation could be threatened with loss of life in the event of their proximity to or involvement in any accident which would act to substantially reduce or contaminate the available supply of air.

Accordingly, many protective hoods and suits have been produced whereby to protect a wearer from the adverse effects of a contaminated environment, such as that containing smoke, and the like. Examples of conventional protective hoods and suits can be found by making reference to one or more of the following United States patents:

| U.S. Pat. No. | Issue Date |
|---|---|
| 1,140,025 | May 19, 1915 |
| 2,709,667 | May 31, 1955 |
| 3,458,864 | August, 1969 |
| 3,521,629 | July 28, 1970 |
| 3,562,813 | February 16, 1971 |
| 3,895,625 | July 22, 1975 |
| 4,231,118 | November 4, 1980 |

However, several shortcomings exist in the design and operation of the conventional protective hood and suit. Many of the conventional hoods and suits fit relatively snugly around the head and face of the wearer. Therefore, to enable the wearer of such a conventional garment to breathe, an auxiliary supply of air is required. In the past, this auxiliary supply of air was provided, for example, by a detachable mask, an air canister, a filtering means, or the like. Unfortunately, such air supply means are bulky and not always easily operated in an emergency situation. What is more, most relatively low cost filtering means are not fully effective in preventing the transmission therethrough of potentially harmful gases (e.g. carbon monoxide) having relatively small contaminants associated therewith. In addition, because of the flush fit made with the wearer's face, condensation often reduces visibility through a conventional protective enclosure within a relatively short amount of time. Moreover, the presence of the aforementioned auxiliary air supply does not readily permit the conventional protective hood or suit to be conveniently folded into a compact package for storage or distribution. What is even more, since conventional hoods are confined to the area of the wearer's head and conventional suits typically form a snug fit around the wearer's body, there is no way by which the wearer of a conventional protective garment can also protect a second individual, such as a small child or baby, within the same garment.

SUMMARY OF THE INVENTION

Accordingly, it is an important object of the present invention to provide a reliable protective envelope that is particularly fabricated to include a self-contained supply of air from which a wearer may breathe when said envelope is being worn in a contaminated (e.g. smoke filled) environment.

It is another object of the present invention to provide a protective envelope that is both relatively inexpensive to fabricate and flexible in construction, so as to permit the envelope to be conveniently folded into a compact package for either storage or distribution.

It is an additional object of the present invention to provide a protective envelope that extends from the head to at least the waist of the wearer in a manner that is suitable to prevent a contaminated environment from entering the envelope.

It is still another object of the present invention to provide a protective envelope in which a wearer may enclose both himself and a baby or small child.

It is yet another object of the present invention to provide a protective envelope that is fabricated from a strong, flexible material having a varying thickness, so that a relatively large airspace can be created above the wearer's head and an airtight seal can be made around the wearer's waist.

It is another object of the present invention to provide a protective envelope having an opened side so that the envelope can receive at least the head of the wearer therethrough and fastening means so that the opened side can be positioned at and closed against the chest of the wearer.

These and other objects and advantages of the invention will become apparent as the following description proceeds and the features of novelty which characterize the invention will be pointed out with particularity in the claims annexed to and forming part of this specification.

DESCRIPTION OF THE PREFERRED EMBODIMENTS

Figure 1:
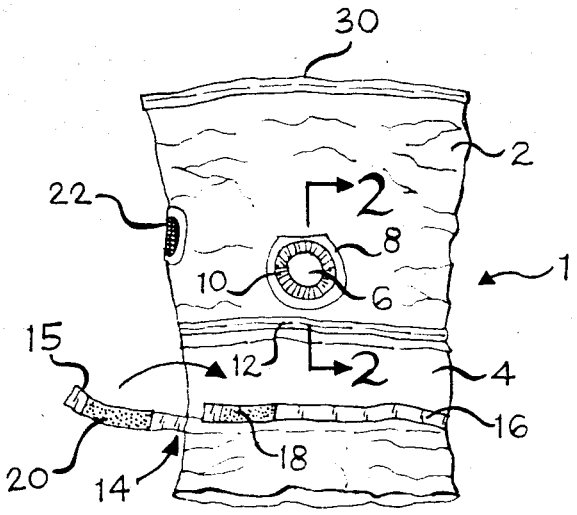
FIG. 1 is a side view showing the protective enclosure which forms a first preferred embodiment of the present invention.
Figure 2:
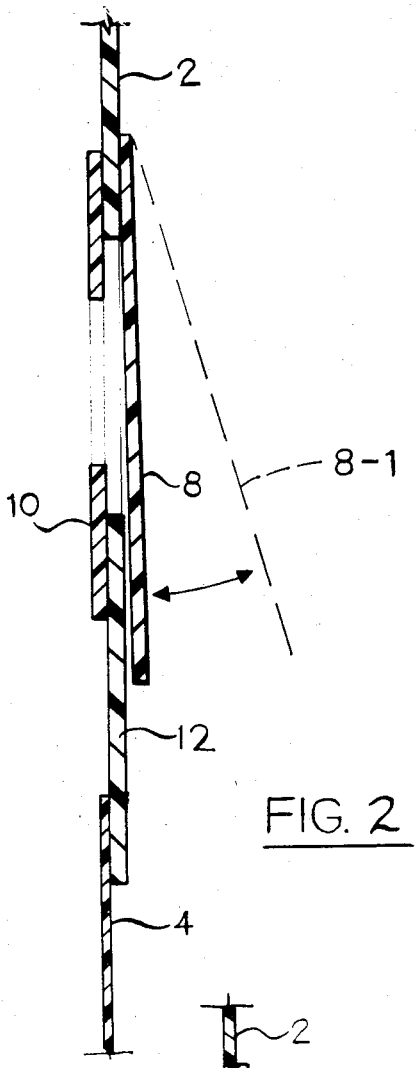
FIG. 2 is a cross-section taken along lines 2—2 of FIG. 1 showing the relative thickness of the hood and skirt portions which form the present protective enclosure.
Figure 3:
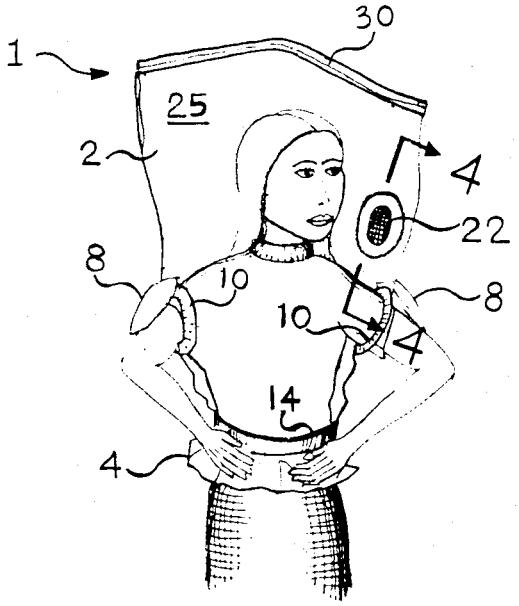
FIG. 3 is a front view of the protective enclosure of FIG. 1 being worn and the airspace that is thereby created around the head of the wearer.

The protective enclosure which forms a first preferred embodiment of the present invention is initially described while referring concurrently to FIGS. 1–3 of the drawings. The enclosure preferably comprises a bag 1 that is fabricated from a clear, flexible, heat resistant, plastic material, such as vinyl, or the like. Protective bag 1 comprises an upper hood portion 2 and a lower skirt portion 4. In a preferred embodiment of the invention, and as is best represented in FIG. 2, the walls of the hood portion 2 are thicker than the corresponding walls of the skirt portion 4. By way of particular example, the walls of hood portion 2 are approximately 6 mils thick, and the walls of skirt portion 4 are approximately 3–4 mils thick. The advantages of fabricating protective bag 1 with hood and skirt portions 2 and 4 having different thicknesses will be described in greater detail hereinafter. The hood and skirt portions 2 and 4 are attached to one another along a seam 12 that is created by a suitable bonding technique, such as that comprising a heat sealing step. In the assembled relationship, the hood and skirt portions 2 and 4 of protective bag 1 are dimensioned so as to each extend for approximately one-half the overall length of bag 1.

The top edges of protective bag 1 are sealed together to form a relatively stiff, closure member 30. Closure member 30 extends along the entire width of protective bag 1, in order to form an airtight seal across the top thereof. By virtue of closure member 30, the top corners of bag 1 are generally square. Moreover, and as is best shown in FIG. 3, the square top corners are approximately preserved when bag 1 is worn, so as to prevent the hood portion 2 from collapsing around the head of the wearer. The bottom of bag 1 is open ended, so as to be adapted for placement over the head and upper body of the wearer.

Located at opposite sides of protective bag 1 is a pair of arm ports 6. The arm ports are preferably located above the seam 12 that is created during the interconnection of the hood and skirt portions 2 and 4. Each arm port 6 comprises an aperture (e.g. such as an elongated slit or a rounded opening) that is established through the opposite sides of protective bag 1. Arm ports 6 are particularly sized in order to receive the arms of a wearer therethrough. A relatively thin piece of tape or paper material 8 is attached to the exterior surface of protective bag 1 so as to cover each arm port 6 with a flap. Material 8 is selected with a suitable thickness and is adapted to be easily broken or removed whenever the wearer of protective bag 1 thrusts his arms through arm ports 6. The position assumed by flap 8 when the wearer projects an arm through a respective arm port 6 is shown in phantom and represented by the reference numeral 8-1 in FIG. 2.

A well-known and readily available elastic material is attached to the interior surface of protective bag 1 around the aperture which defines each arm port 6. Therefore, the elastic material forms a short sleeve 10 that extends inwardly from each arm port 6. However, the diameter of each elastic sleeve 10 is made smaller than the diameter of the openings established through protective bag 1 to form respective arm ports 6. Therefore, the elastic sleeve 10 will be adapted to form a tight seal around the arm of a wearer whenever the wearer extends one or both of his arms through respective arm ports 6.

The skirt portion 4 of protective bag 1 is provided with a suitable fastening means by which bag 1 may be securely tightened around the waist of a wearer. By way of one particular example, the aforementioned fastening means comprises a belt 14. Belt 14 may include a pair of belt sections 15 and 16. Each belt section 15 and 16 may be integrally connected (i.e. bonded) to protective bag 1 around some or all of the periphery thereof. One belt section 16 is provided with a suitable interlocking means 18 connected thereto. By way of example, interlocking means 18 may be a material that is known in the art as VELCRO. The VELCRO material 18 covers a portion of the outwardly exposed surface of belt section 16. The other belt section 15 is provided with a complementary interlocking means 20. By way of the present example, interlocking means 20 also comprises VELCRO material. The VELCRO material 20 covers the underside or downwardly exposed surface of a loosely hanging portion of belt section 15. The loosely hanging portion of belt section 15 can be pulled across the wearer's waist in a direction towards belt section 16, whereby to close the skirt portion 4 of bag 1 around the waist of the wearer. In this way, the respective VELCRO materials 20 and 18 of belt sections 15 and 16 can be aligned and mated to one another in conventional fashion, so that the skirt portion 4 will be securely attached to the wearer's waist while making an airtight seal therearound.

The utilization of the presently disclosed protective bag 1 by an individual trapped within a contaminated environment is best described while referring to FIGS. 1 and 3 of the drawings. In the event of a fire or other serious accident from which smoke or toxic fumes are generated, the protective bag 1 of the present invention forms a reliable means by which to protect the wearer against inhaling poisonous gases. In addition, the protective bag 1 provides the wearer with a reserve supply of air to give the wearer additional time by which to negotiate his rescue from the contaminated environment. Accordingly, a wearer who finds himself trapped within a potentially contaminated environment merely slips the protective bag 1 over his head and upper body at the opened bottom end thereof. Because of the relative symmetry that is characteristic of protective bag 1, bag 1 may be positioned in any convenient alignment with the wearer's body, so long as the arm ports 6 are positioned to receive the wearer's arms therethrough. However, should protective bag 1 include a belt 14, such as that having interlocking belt sections 15 and 16, then bag 1 should be positioned over the wearer's head so that the belt 14 is located at the front of the wearer. Accordingly, with the bag 1 positioned over the wearer's upper body, the wearer projects each arm through a passage comprising elastic sleeve 10, arm port 6, and the covering material or flap (designated 8 in FIG. 2). The wearer is then free to tighten the skirt portion 4 around his waist by drawing belt section 15 towards belt section 16 and interlocking the mating (e.g. VELCRO) portions thereof. By varying the distance through which belt section 15 is drawn towards belt section 14, the skirt portion 4 can be securely tightened around a waist of practically any dimension.

The combination of covering flap material 8 and elastic sleeve 10 with arm port 6 provides an important aspect of the present invention. In a first case, in the event that both of the wearer'arms are extended through respective arm ports 6, the elastic sleeve 10 at the interior surface of protective bag 1 provides a seal by which to prevent noxious gases from communicating with the interior of bag 1 via arm ports 6. In a second case, it may be desirable that both a baby or small child and the wearer be concurrently afforded the protection of bag 1. More particularly, one of the arms of the wearer can be extended through a corresponding arm port 6, so as to permit the wearer to fasten belt 14 around his waist. However, the second arm of the wearer may remain within the enclosure of protective bag 1 in order that the wearer may clutch the baby or child against his body. In this case, the flap material 8 which covers each arm port 6 at the exterior surface of protective bag 1 prevents noxious gases from communicating with the interior of bag 1 via an arm port 6. Hence, covering material 8 and elastic sleeve 10 act to prohibit the entry of smoke and noxious gases into bag 1 in the event that the arms of the wearer are either extended through or retained within the enclosure or protective bag 1.

As was previously disclosed, the top edges of protective bag 1 are sealed together, so as to form a relatively stiff closure member 30. Therefore, and unlike prior art protective bags which collapse substantially around the wearer's head, the present protective bag 1 is adapted to provide a self-contained air supply from which the wearer may breathe. More particularly, the square corners formed at the top of protective bag 1 (which corners are formed by virtue of the closure member 30) are generally preserved during use, so as to prevent bag 1 from collapsing around the head of the wearer. Thus, a relatively large airspace 25 is created around the head of the wearer, in which a reserve supply of breathing air becomes available. The actual size of the airspace 25 will vary, depending upon the sizes of the protective bag 1 and the wearer. However, and by way of particular example, it has been found that a protective bag 1, formed in accordance with the present invention and having a height of approximately four feet is sufficient to provide approximately a 15 to 20 minute reserve supply of air for a wearer who is approximately five to six feet tall.

Accordingly, the protective bag 1 of the present invention is adapted to provide a potentially life saving supply of air from which the wearer may breathe without the necessity of masks, air canisters, or the like, as has heretofore been utilized with protective enclosures of the prior art. By virtue of the present protective bag 1, the wearer thereof may now have ample time in which to either await his rescue or to remove himself from a contaminated environment. The protective enclosure is fabricated from a relatively thick hood portion 2 and a thinner skirt portion 4. Accordingly, the hood portion 2 is provided with increased rigidity for maximizing the size of the airspace 25, while the flexibility of skirt portion 4 is maximized to enhance the ability by which skirt portion 4 can be secured around the waist of the wearer.

Figure 4:
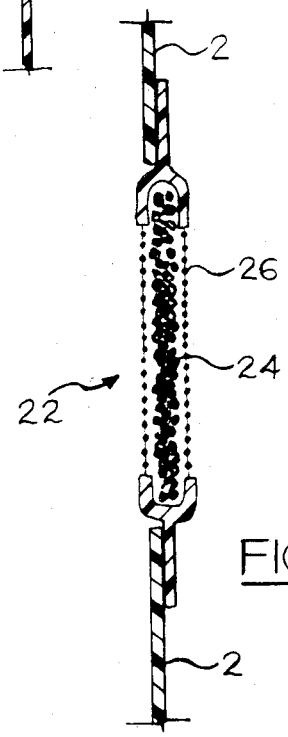
FIG. 4 is a cross-section taken along lines 4—4 of FIG. 3 detailing the optional filter arrangement that may be established within the present protective enclosure.

As an alternate embodiment of the present invention, one or more conventional filtering means 22 may be installed within the hood portion 2 of protective bag 1. As is best shown in FIG. 4 of the drawings, filter 22 comprises a compartment that contains a well-known filtering material 24 for removing smoke particles and other relatively large contaminants. The filtering material 24 is typically surrounded by a gauze or light fabric material 26. Filter 22 can be used should the wearer of protective bag 1 find it necessary to breathe additional air in the event that the reserve supply of air contained within airspace 25 becomes substantially exhausted. Moreover, the outside of the filter 22 can be covered by a removable flap (not shown), so that the wearer of protective bag 1 may be totally isolated from the contaminated environment.

Figure 5:
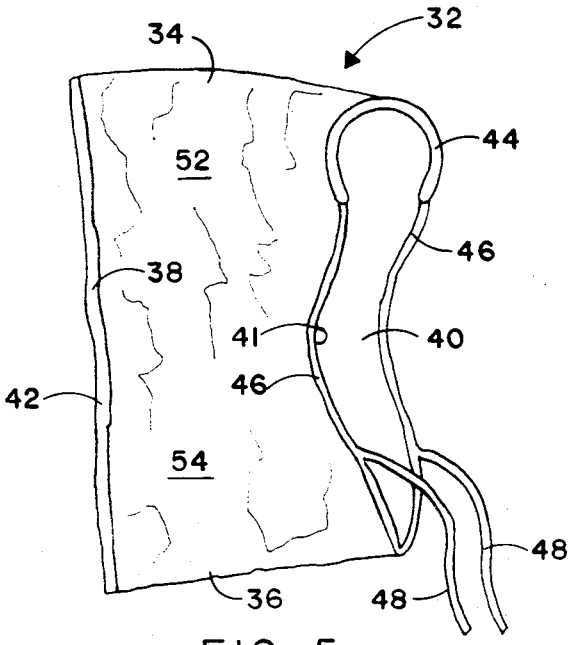
FIG. 5 shows the protective enclosure which forms a second preferred embodiment of the present invention.

The protective enclosure which forms a second preferred embodiment of the present invention is described while referring to FIG. 5 of the drawings. The enclosure 32 is preferably fabricated from a relatively thin (e.g. approximately 6 mils thick), clear, flexible, and heat resistant material such as, for example, vinyl, nylon film, or the like. Protective enclosure 32 comprises a top 34, a bottom 36, and a front side 38. Each of the top 34, bottom 36, and front side 38 includes respective ends which are sealed together. In accordance with the present invention, and unlike the protective hoods and suits of the prior art, the back side 40 (i.e. the side opposite front side 38) of protective enclosure 32 is open-ended, so as to be adapted, as will be disclosed in greater detail hereinafter, to receive therethrough the head of a wearer. As will be appreciated by those skilled in the art, the bottoms of protective enclosures of the prior art are typically opened for receipt therein of a portion (e.g. the head) of the wearer's body. However, the availability therein of a self-contained, reserve supply of air is undesirably limited when the prior art enclosures are worn. Hence, the aforementioned prior art enclosures are not particularly suitable for use during relatively long and continuous intervals of time in a contaminated environment (e.g. such as that occurring as a result of a fire or the presence of toxic gases and noxious fumes) wherein the natural supply or availability of breatheable air is restricted.

The sealed ends of protective enclosure 32 which form the front side 38 thereof also include a relatively stiff closure member 42 attached thereto. Additional material (e.g. flexible plastic) may be applied to front side 38, so as to reinforce the closure member 42. Closure member 42 preferably extends along the entire length of the front side 38. A flexible collar member 44 may be connected (e.g. sewn) around a top portion of the peripheral walls which define the opened back side 40. Flexible collar member 44 is fabricated from a soft, resilient material, so as to provide a cushion and thereby create a comfortable fit around the neck and shoulders of a wearer when the enclosure 32 is positioned thereover. A hollow channel 46 is attached (e.g. heat sealed) around the remainder of the peripheral walls (i.e. between opposite ends of collar member 44) which define the opened back side 40 of protective enclosure 32. A lightweight elastic band or drawstring is located within the hollow channel 46. A pair of elongated drawstring ends 48 are connected to the drawstring contained within channel 46. Drawstring ends 48 extend outwardly from channel 46 at a location corresponding to approximately one quarter of the overall length of opened side 40, as measured upwardly from the bottom 36 of enclosure 32. Drawstring ends 48 are utilized to secure the opened side 40 of protective enclosure 32 against the chest of the wearer, as will soon be described.

The protective enclosure 32 of the present invention is provided with a particular configuration that is adapted to establish a relatively large reserve supply of air therewithin to which the wearer will have access when the enclosure 32 is worn in a contaminated environment. More particularly, the end of enclosure 32 at which opened side 40 is formed is shaped to generally conform to a human chest cavity. That is, the width of the enclosure 32 (as measured between the front and back sides 38 and 40 thereof) gradually narrows and then widens, so that a constriction 41 is formed approximately midway between the top and bottom 34 and 36 of enclosure 32 at the end of enclosure 32 at which opened side 40 is established. Accordingly, enclosure 32 is provided with relatively wide upper and lower hood portions 52 and 54 located, respectively, above and below the constriction 41.

The aforementioned configuration of enclosure 32 is particularly advantageous, inasmuch as (and as will be described in greater detail hereinafter) a relatively large supply of air can be stored within the hood portions 52 and 54 thereof. Moreover, the positions of collar member 44, drawstrings 48, and the curvilinear opened back side 40 of enclosure 32 will better enable a wearer, who is confronted with an emergency condition, to become quickly aware of the preferred method for utilizing enclosure 32, especially in situations where visibility is limited.

Figure 6:
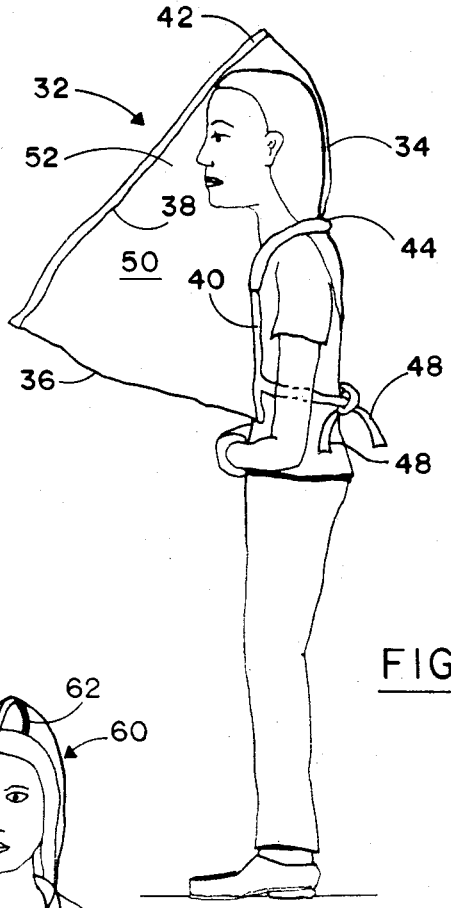
FIG. 6 shows the protective enclosure of FIG. 5 being worn and the airspace that is thereby created around the head of the wearer.
Figure 7:
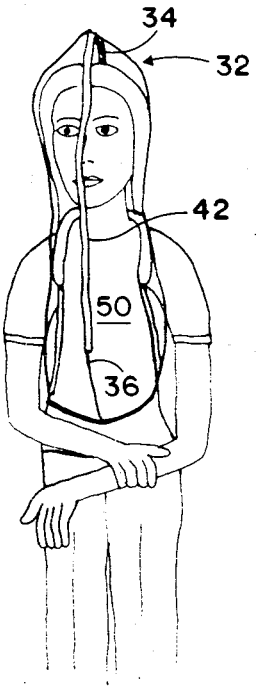
FIG. 7 is a front view of the protective enclosure when being worn, as in FIG. 6.

The method by which the protective enclosure 32 of the present invention is utilized to provide a wearer with a reserve supply of air from which he may breathe while located within an otherwise contaminated environment is best described while referring concurrently to FIGS. 6 and 7 of the drawings. When a wearer is confronted with an emergency situation (e.g. a fire), such as that from which a contaminated environment including smoke, noxious fumes, or the like, is produced, the wearer merely places the protective enclosure 32 over his head via the opened back side 40 thereof, so that the flexible collar portion 44 is positioned around the wearer's neck and the ends of enclosure 32 which define opened side 40 are located adjacent the wearer's chest. The wearer then grasps and pulls upon the drawstring ends 48, whereby to compress enclosure 32 while securing the opened back side 40 thereof against his chest (best illustrated in FIG. 6). The drawstring ends 48 are tied together around the waist of the wearer, so as to cause an airtight seal to be formed between the wearer's chest and the ends of enclosure 32 which form the back side 40 thereof. Thus, the protective enclosure 32 may be applied over the head and secured to the chest of the wearer in a relatively few seconds to form an airtight enclosure for reliably protecting the wearer against the adverse effects of inhaling posionous gases. While the protective enclosure 32 is being worn, as described in the preferred arrangement of FIGS. 6 and 7, the arms and the back of the wearer are positioned at the exterior thereof, so as to provide the wearer with a relatively high degree of freedom of movement while awaiting a rescue or seeking an escape from the contaminated environment.

By virtue of the previously disclosed, relatively stiff closure member 42, the corners of the protective enclosure 32 are preserved between the front side 38 and the top and bottom 34 and 36, respectively, so as to prevent the enclosure 32 from collapsing around the head and against the chest of the wearer. What is more, in accordance with an important aspect of the present embodiment and unlike prior art protective enclosures which collapse substantially around the wearer's head, the presently disclosed protective enclosure 32 is adapted to provide a relatively large, self-contained air supply from which the wearer may breathe. More particularly, an airspace 50 is created in hood portions 52 and 54 around the head and adjacent the chest, of the wearer, so as to provide the wearer with an available reserve supply of breathing air in the event that the air normal to his environment becomes contaminated. By way of particular example and as is also best shown in FIG. 6, when applied over the head of a wearer, the protective enclosure 32 assumes a generally conical configuration by which to define the airspace 50 therewithin. The head of the wearer is positioned at approximately the base of the conical configuration defined by protective enclosure 32 in order that the wearer can readily have access to the reserve supply of air stored within hood portions 52 and 54.

Accordingly, a wearer who finds himself within a potentially dangerous environment merely places the protective enclosure 32 over his head via the opened back side 40 thereof. By virtue of the present invention, the protective enclosure 32 (similar to the protective bag 1 described while referring to FIGS. 1–4 hereinabove), provides the wearer with a temporary supply of air so as to give the wearer additional time by which to negotiate his escape from an environment that has been contaminated with smoke, toxic and noxious fumes, and the like. By way of particular example, it has been found that a protective bag 32 formed in accordance with the present embodiment and having a height of approximately 2½ feet and a width of approximately two feet is sufficient to provide a wearer with approximately a ten minute reserve supply of air, during which time the wearer can attempt to extricate himself from the contaminated surroudings.

Figure 8:
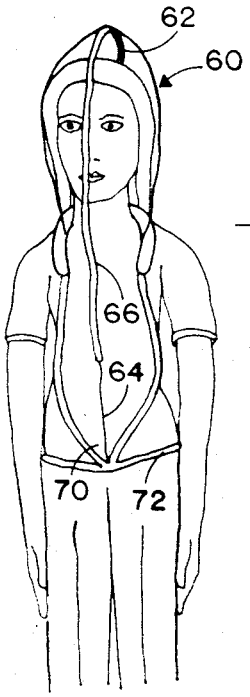
FIG. 8 is a front view of a modified form of the protective enclosure of FIG. 5, as worn.
Figure 9:
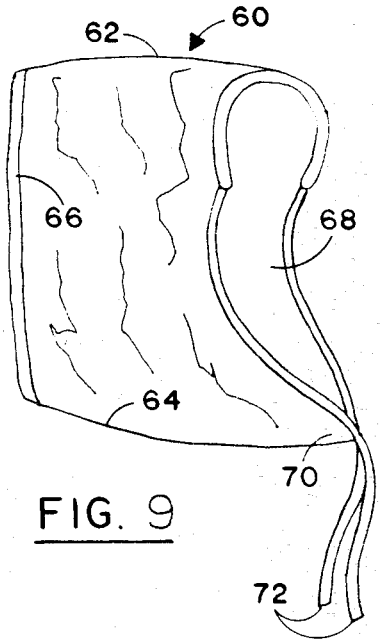
FIG. 9 is a more detailed illustration of the modified protective enclosure of FIG. 8.

A modification of the protective enclosure 32 of FIGS. 5–7 is disclosed while referring to FIGS. 8 and 9 of the drawings. The modified protective enclosure 60 is substantially identical in construction and utilization to the previously described enclosure 32. That is, enclosure 60 includes a top 62, a bottom 64, and a front side 66. Protective enclosure 60 also includes an open-ended back side 68 which is adapted to receive the head of a wearer therethrough. An elastic band or drawstring is located within a hollow channel that extends around a portion of the peripheral walls which define opened back side 68. The ends 72 of the drawstring are operated by the wearer to secure the walls of the opened side 68 of protective enclosure 60 at the wearer's chest and thereby close the opened side 68 thereat.

In accordance with the modification of the present embodiment, protective enclosure 60 is provided with an extension 70 thereof (best shown in FIG. 9). More particularly, the extension 70 comprises an elongation of enclosure 60 at the interface of the walls thereof which form the bottom 64 and opened back side 68. The drawstring ends 72 extend outwardly from enclosure 60 at the aforementioned interface between bottom 64 and opened back side 68.

The advantage of enclosure extension 70 is best described while referring to FIG. 8. Similar to that described when referring to FIGS. 6 and 7, in operation, the wearer places protective enclosure 60 over his head via opened back side 68, so that the ends of enclosure 60 which define opened side 68 are located adjacent the wearer's chest. The wearer then pulls upon the drawstring ends 72, whereby to compress enclosure 60 while securing the opened back side 68 thereof against his chest. However, and by virtue of the extension 70, the enclosure 60 defines an airspace which is both elongated and narrow (relative to the airspace 50 previously described while referring to FIG. 7). That is, when the drawstring ends 72 are tied around the body of the wearer, the extension 70 of enclosure 60 is positioned at approximately the wearer's hips. The resulting long and narrow airspace is especially desirable when the wearer must exit through a narrow doorway when seeking his escape from a contaminated environment. Hence, the modified protective enclosure 60 has particular application for use in an airplane, and the like.

As will be appreciated by those skilled in the art, the presently disclosed protective envelopes 1, 32 and 60 may be relatively easily manufactured at a relatively low cost. Moreover, by virtue of the flexible nature thereof, each of the protective envelopes may be folded into a compact configuration whereby to be placed in a storage container or package. In this way, a plurality of protective envelopes may be conveniently stored or distributed so as to be made available for use by occupants of high-rise buildings, transportational sources, and the like. The presently disclosed protective envelopes 1, 32 and 60 are particularly advantageous because of the relative ease by which they may be worn. Moreover, and unlike any known prior art protective enclosure, a baby or small child may also be protected within the enclosure of at least one of the preferred envelopes (designated by reference numeral 1). What is more, the wearer's head will be completely isolated from the contaminated environment surrounding each of the protective envelopes hereinabove disclosed.

It will be apparent that while a preferred embodiment of the present invention has been shown and described, various modifications and changes may be made without departing from the true spirit and scope of the invention. By way of example, the belt 14 and drawstring 48 are disclosed as being preferred means by which to secure the protective enclosures 1 and 32 to the body of the wearer. However, it is to be understood that other securing means may be substituted therefor. By way of an additional example, the belt 14 of bag 1 may be replaced by an elastic band integrally formed with the skirt portion 4. The skirt portion 4 of bag 1 can thereby be self-sealing around the waist of the wearer. Yet an additional example is to replace belt 14 with either of a pair of drawstrings or the combination of a single drawstring and a latching assembly. In the first case, the drawstrings are tied around the waist of the wearer and, in the second case, a drawstring may be locked within a complementary tab or buckle, whereby to tightly secure the skirt portion 4 of protective bag 1 around the waist of the wearer.

Having thus set forth the preferred embodiments of the present invention, what is claimed is:

1. A flexible, gas-tight protective enclosure to be worn over at least the head and some of the chest of a wearer within a contaminated environment to provide the wearer with a temporary supply of air from which to breathe, said enclosure having an opened end for receipt therethrough of the wearer's head and chest and a closed end to be spaced away from the wearer's head and chest and disposed forward of said closed end, said opened end having walls of flexible construction and associated fastening means by which to make a gas-tight closure of said opened end against the chest of the wearer, such that an airspace containing the temporary supply of air is provided between the wearer's chest and said closed enclosure end and around the wearer's head, said gas-tight enclosure isolating the wearer's head within said airspace from fluid communication with the contaminated environment exterior of said enclosure to permit the wearer of said enclosure to breathe while within the contaminated environment.

2. The flexible gas-tight protective enclosure recited in claim 1, wherein said closed enclosure end has a relatively rigid member associated therewith so as to prevent a collapse of said closed end and preserve the airspace formed around the head of the wearer.

3. The flexible, gas-tight protective enclosure recited in claim 1, wherein the flexible walls of said opened enclosure end have a contour so as to conform to the shape of the wearer's chest for forming a secure, gas-tight fit thereagainst.

4. The flexible, gas-tight protective enclosure recited in claim 1, further having a collar arranged along said opened enclosure end, said collar being received around the neck of the wearer when said enclosure is worn within the contaminated environment.

5. The flexible, gas-tight protective enclosure recited in claim 1, wherein the fastening means associated with said opened enclosure end surrounds the wearer's body at a location below the shoulders for forming a gas-tight closure of said opened end against the chest of the wearer.

6. The flexible, gas-tight protective enclosure recited in claim 1, wherein said opened enclosure end has a sufficient length to be extended to and closed against an area of the wearer's body adjacent the hips.

7. The flexible, gas-tight protective enclosure recited in claim 1, wherein said enclosure is fabricated from a clear, flexible plastic material.

8. The flexible, gas-tight protective enclosure recited in claim 1, further having a top and a bottom extending between said opened and closed enclosure ends for separating said closed end from said opened end and positioning said closed end forward of and opposite said closed end.

9. The flexible, gas-tight protective enclosure recited in claim 8, wherein said enclosure top and said opened enclosure end are aligned adjacent one another to form a continuous portion of said enclosure from the head to a location below the shoulders and above the waist of the wearer.

10. The flexible, gas-tight protective enclosure recited in claim 1, wherein said airspace between the wearer's chest and the closed enclosure end has a generally conical configuration.

11. The flexible, gas-tight protective enclosure recited in claim 1, wherein the fastening means associated with said opened enclosure end includes a drawstring connected to said opened end and surrounding a least some of the wearer's trunk below the shoulders.

* * * * *